US008474517B2

(12) United States Patent
Borst et al.

(10) Patent No.: US 8,474,517 B2
(45) Date of Patent: Jul. 2, 2013

(54) HEAT EXCHANGER WITH COLLECTING TUBE, COLLECTING TUBE, AND METHOD FOR PRODUCING THE SAME

(75) Inventors: Daniel Borst, Wolfschlugen (DE); Christoph Schiebel, Tübingen (DE); Frank Vetter, Neuhausen (DE)

(73) Assignee: Modine Manufacturing Company, Racine, WI (US)

( * ) Notice: Subject to any disclaimer, the term of this patent is extended or adjusted under 35 U.S.C. 154(b) by 842 days.

(21) Appl. No.: 12/511,771

(22) Filed: Jul. 29, 2009

(65) Prior Publication Data

US 2010/0025027 A1 Feb. 4, 2010

(30) Foreign Application Priority Data

Jul. 29, 2008 (DE) ..... 10 2008 035 358

(51) Int. Cl.
*F28D 9/02* (2006.01)

(52) U.S. Cl.
USPC ..... 165/173; 165/175; 165/176; 165/906; 29/890.03; 29/890.052; 29/890.053; 138/38

(58) Field of Classification Search
USPC ..... 165/148, 149, 151, 153, 173–179; 29/890.03, 890.052, 890.053; 138/38
See application file for complete search history.

(56) References Cited

U.S. PATENT DOCUMENTS

| | | | | |
|---|---|---|---|---|
| 4,770,240 | A * | 9/1988 | Dawson et al. | 165/176 |
| 5,056,265 | A * | 10/1991 | Hurst | 451/69 |
| 5,163,509 | A * | 11/1992 | Dawson | 165/176 |
| 5,190,101 | A * | 3/1993 | Jalilevand et al. | 165/176 |
| 6,216,777 | B1 * | 4/2001 | Rhodes et al. | 165/176 |
| 6,260,271 | B1 * | 7/2001 | Hayashi | 29/890.035 |
| 6,272,881 | B1 * | 8/2001 | Kuroyanagi et al. | 62/525 |
| 6,360,560 | B1 * | 3/2002 | Whitlow et al. | 62/509 |
| 6,736,203 | B2 * | 5/2004 | Rhodes et al. | 165/176 |
| 7,183,615 | B2 | 2/2007 | Yamashita et al. | |
| 7,275,394 | B2 * | 10/2007 | Lundberg | 62/515 |
| 7,343,966 | B2 * | 3/2008 | Nitta | 165/176 |
| 2001/0040027 | A1 * | 11/2001 | Tooyama et al. | 165/153 |
| 2004/0182558 | A1 * | 9/2004 | Watanabe et al. | 165/173 |
| 2004/0182559 | A1 * | 9/2004 | Kent et al. | 165/183 |
| 2006/0054313 | A1 * | 3/2006 | Forster et al. | 165/173 |
| 2008/0029256 | A1 * | 2/2008 | Durr et al. | 165/153 |
| 2008/0078541 | A1 * | 4/2008 | Beamer et al. | 165/174 |

FOREIGN PATENT DOCUMENTS

| | | | |
|---|---|---|---|
| DE | 10302412 | | 7/2004 |
| DE | 102007039756 | | 6/2008 |
| EP | 0567399 | A1 * | 4/1993 |
| JP | 11325784 | | 11/1999 |

(Continued)

*Primary Examiner* — Cheryl J Tyler
*Assistant Examiner* — David Teitelbaum
(74) *Attorney, Agent, or Firm* — Michael Best & Friedrich LLP

(57) ABSTRACT

A heat exchanger, such as a condenser or gas cooler, having a collecting tube which has a wall and which can be produced by deformation of a single metal strip, which collecting tube has, in its base, at least one row of openings in which heat exchanger tubes, each of which has two narrow and two wide sides, are fastened at their ends. The collecting tube can have at least two chambers, which adjoin one another approximately at a central longitudinal axis, and also a reinforcement, which is formed by the longitudinal edge strips of the metal strip.

16 Claims, 8 Drawing Sheets

FOREIGN PATENT DOCUMENTS

| | | |
|---|---|---|
| JP | 11351783 | 12/1999 |
| JP | 2001066089 | 3/2001 |
| JP | 2003114094 | 4/2003 |
| WO | 02/079708 | 10/2002 |

* cited by examiner

HEAT EXCHANGER WITH COLLECTING TUBE, COLLECTING TUBE, AND METHOD FOR PRODUCING THE SAME

CROSS-REFERENCE TO RELATED APPLICATIONS

Priority is hereby claimed to German Patent Application No. DE 10 2008 035 358.2, filed Jul. 29, 2008, the entire contents of which is incorporated herein by reference.

SUMMARY

The present invention relates to a heat exchanger, in particular a condenser or gas cooler, having the further features of the preamble of claim 1. The invention also relates to a collecting tube for the above-specified heat exchanger and to a method for producing the same.

WO 02/079708 A2 discloses a conventional heat exchanger. Here, the profile of the collecting tube is advantageously produced by deformation of a single-piece metal strip, as illustrated for example in FIG. 1, FIG. 6A and FIG. 11A. The short connections of the longitudinal edge strips of the metal strip to the base, as can be seen in particular from FIG. 14A and FIG. 14B, appear to be disadvantageous with regard to pressure resistance, in particular when said heat exchanger is used as a gas cooler for $CO_2$ air-conditioning circuits. In this regard, see also document JP 05-026592, FIG. 8. The slight reinforcement of the base that can be obtained therein is not sufficiently stable for many applications.

The tank for high-pressure refrigerant heat exchangers presented in German patent application DE 10 2007 039 756 A1 is also produced in one piece from a metal strip, with internal stiffening structures of the tank, such that the tank must be produced in a plurality of successive embossing and deep-drawing steps.

German patent application DE 103 02 412 A1 likewise presents a collecting tube: the profile of said collecting tube is produced in one piece, as shown for example in FIGS. 2, 5 and 7. It is thereby possible to use a cost-effective production process. However, it is necessary to select a relatively large material thickness for the profile or for the metal strip in order to ensure the strength of the collecting tube under the high operating pressures that are typical for condensers and in particular for gas coolers.

One independent object of the invention is to provide a heat exchanger which is improved with regard to internal pressure resistance and costs for production and material expenditure.

One or more objects are achieved according to the invention with regard to the heat exchanger by means of the use of the features of claim 1. Other claims contain refining features of the heat exchanger.

According to some embodiments of the invention, the base of the collecting tube is reinforced between the heat exchanger tubes, in order to increase the internal pressure resistance, by virtue of the longitudinal edge strips of the metal strip nestling at the inside against the contour of the base over at least ⅓ of the surface area of the base, preferably at least over 50% to 70% of the total surface area, and thereby providing reinforcement, by forming at least a doubled wall thickness, in the region weakened by the openings for the heat exchanger tubes. Within the context of the invention, the base is to be understood approximately to mean that strip-shaped region, which runs in the longitudinal direction, on the collecting tube which is assigned to the openings for the heat exchanger tubes and which extends approximately from the one narrow side to the other narrow side of the heat exchanger tubes or of the openings. Here, said type of reinforcement increases not only the internal pressure resistance but rather also the dimensional stability required for the soldering, welding or brazing process. The above-specified 50% to 70% of the base over which the longitudinal edge strips nestle is a preferred range. In the case of an approximately rectangular design of the cross section of the chambers of the collecting tube, it is also possible for a range of approximately 70% to 90% to be provided.

A collecting tube according to the invention is characterized in that the reinforcement which is formed from the longitudinal edge strips extends at least over ⅓ of the surface area of the base.

A method according to the invention for producing the collecting tube is characterized in that the two longitudinal edge strips are rolled in and thereby bear against the inner side of the base in such a way as to reinforce at least ⅓ of the surface area of the base, but preferably considerably more than ⅓.

The profile of the collecting tube is produced in one piece from a metallic strip, preferably from an aluminum strip, wherein the strip may be solder-plated on one side or both sides. To ensure the best resistance to the high internal pressures in particular in operation as a gas cooler for $CO_2$ motor vehicle air-conditioning systems, the two chambers of the collecting tube profile have approximately a circular shape: the ideal circular shape is sought for the internal pressure loading, which circular shape is divided here, to reduce the structural height, into two individual circular shapes which are however adjacent and connected to one another.

Here, the two longitudinal edge strips of the endless metal strip are deformed inwardly in such a way as to form two overlapping regions of the inwardly rolled longitudinal-side ends of the metal strip with two sections situated in the edge region of the heat exchanger tubes. Here, the inwardly rolled longitudinal edge strips of the metal strip nestle against the base or against the wall. The profile of the collecting tube is thus composed of two shapes which virtually correspond to the ideal circular shape and which are connected to one another approximately along the central longitudinal axis of the collecting tube and to the base of the collecting tube approximately in the edge region of the heat exchanger tubes. In contrast to known designs, the reinforcements according to the invention formed from the longitudinal edge strips significantly improve the internal pressure resistance, since said reinforcements extend over the greater part of the base. In this way, the best possible internal pressure resistance is obtained with a reduced material thickness. This advantage is not provided for example in the published document WO 02/079708 A2, since here, the longitudinal edge strips of the metal strip nestle against the base region, and are connected to the latter, in each case only over approximately three times the material thickness of the metal strip.

The medium to be cooled is conducted through heat exchanger tubes, wherein said heat exchanger tubes may for example be formed, as multi-chamber tubes with two narrow sides and two wide sides, from extruded aluminum profiles with a plurality of inner ducts. The multi-chamber tubes are plugged into the openings in the base of the collecting tube, with the ends of the multi-chamber tubes extending approximately up to the inner surface of the inwardly deformed longitudinal edges. The multi-chamber tubes may also be formed from two halves joined together.

To ensure the best possible soldering of the overlapping regions in order to obtain the greatest possible internal pressure resistance, the corresponding surfaces of the overlapping regions are pre-treated in a particular way: it has been found that, by mechanically roughening the surfaces, a particularly uniform and reliable flow of solder is obtained in the region of the overlapping portions. Said locally limited surface treatment is carried out before the deformation of the metal strip to form the profile of the collecting tube. Rotationally symmetrical rotating deformation tools are used for the deformation of the endless metal strip, and the endless metal strip is additionally perforated and punched out before said deformation process.

The collecting tube is of course completed at both end sides with closure covers.

Other aspects of the invention will become apparent by consideration of the detailed description and accompanying drawings.

BRIEF DESCRIPTION OF THE DRAWINGS

The invention is described below on the basis of the appended figures, in two exemplary embodiments. The description contains further features and their advantages. In the figures, in partially schematic form.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
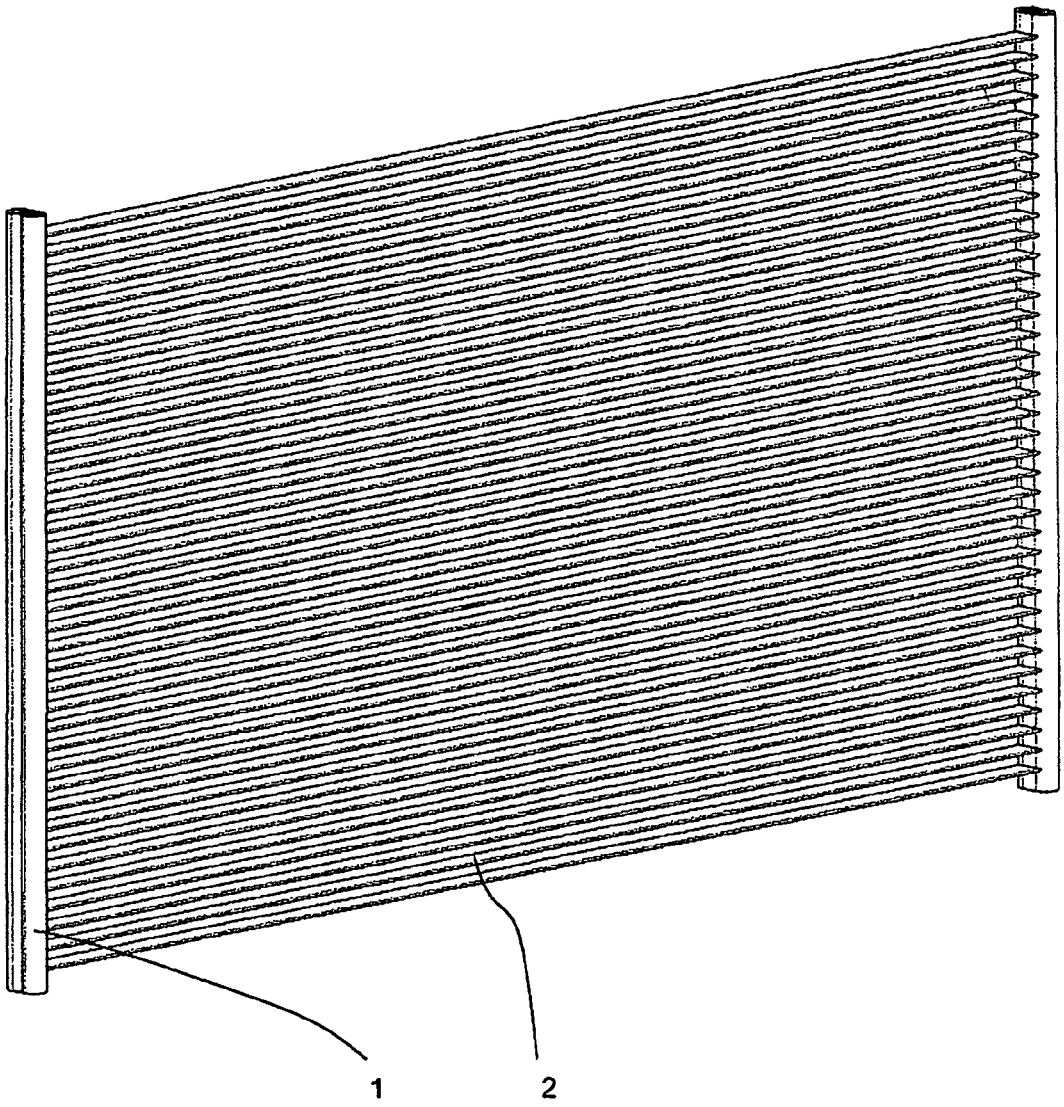
FIG. 1 shows a heat exchanger according to the invention.

FIG. 1 shows a view of a heat exchanger, which is a gas cooler in this exemplary embodiment. The heat exchanger has heat-exchanger tubes 2 with two narrow sides 21 and two wide sides 22, which heat exchanger tubes 2 are designed as multi-chamber tubes, and air-side fins (not illustrated) between the multi-chamber tubes and also between the outermost multi-chamber tubes and the terminating side parts. The heat exchanger tubes 2 are plugged with their ends 20 into a row of openings 12 in the collecting tubes 1 and are sealingly connected there by means of soldering, welding and/or brazing. The collecting tubes 1 are completed with closure covers and connecting pieces (not shown).

Figure 2:
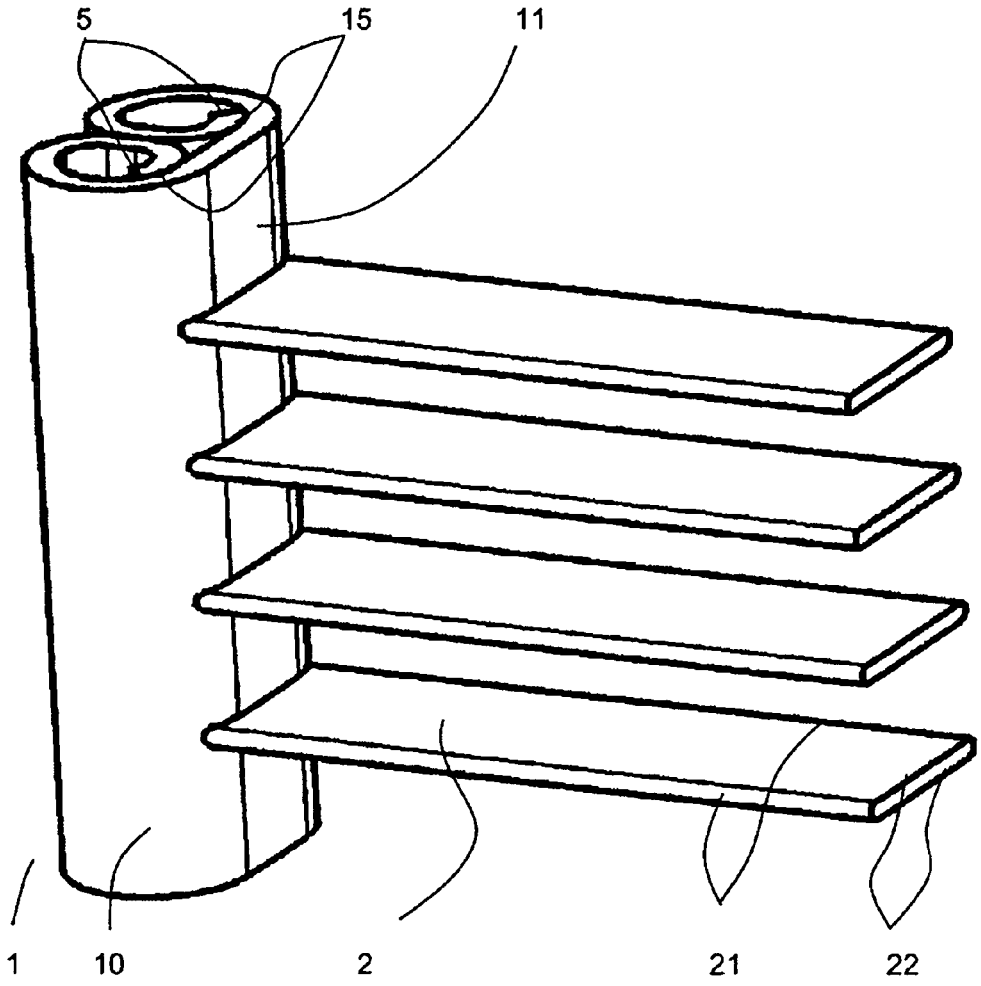
FIG. 2 shows an enlarged partial view of a heat exchanger according to the invention.

FIG. 2 shows the design of the reinforcement 15 in the base region 11 of the collecting tube 1, which reinforcement 15 leads to improved internal pressure resistance of the heat exchanger.

The longitudinal edge strips 5 of the metal strip are deformed inwards in such a way that additional reinforcements 15 are formed between the heat exchanger tubes 2 in the base region 11 of the collecting tube 1, which additional reinforcements 15 extend over the greater region of the base 11. Here, a narrow region 14 along the central longitudinal axis 23 is formed without reinforcement. Said reinforcements 15 in the form of at least a doubled wall thickness also contribute to increased dimensional stability during the soldering, welding and/or brazing process.

Figure 3:
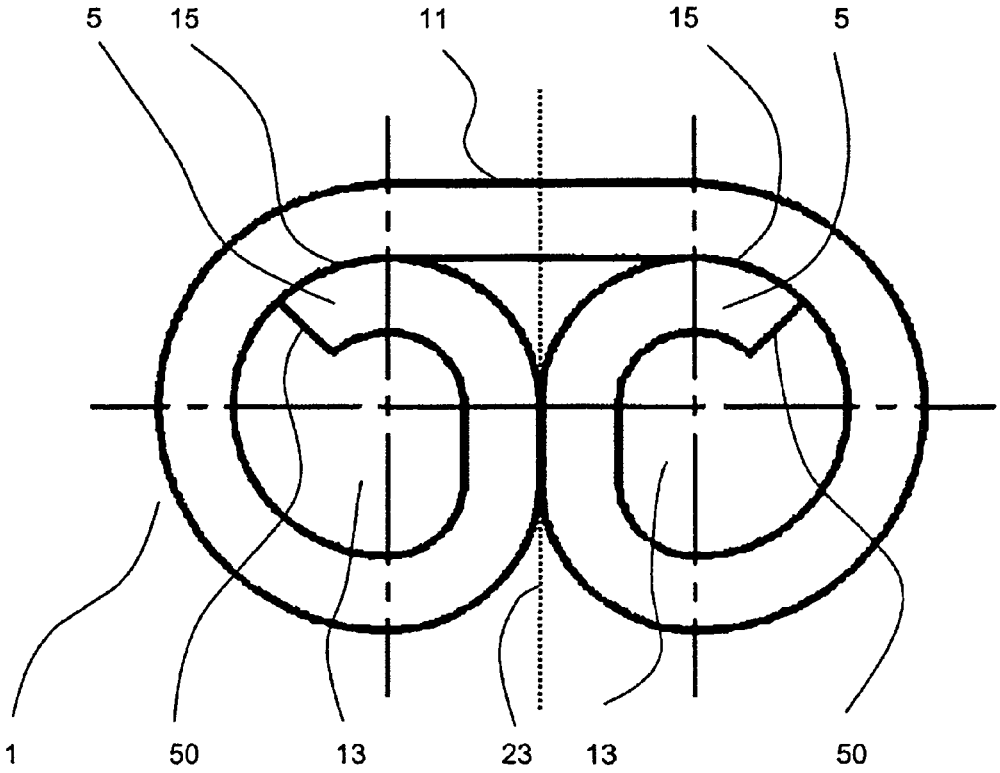
FIG. 3 shows a cross section through the collecting tube according to the invention.
Figure 4:
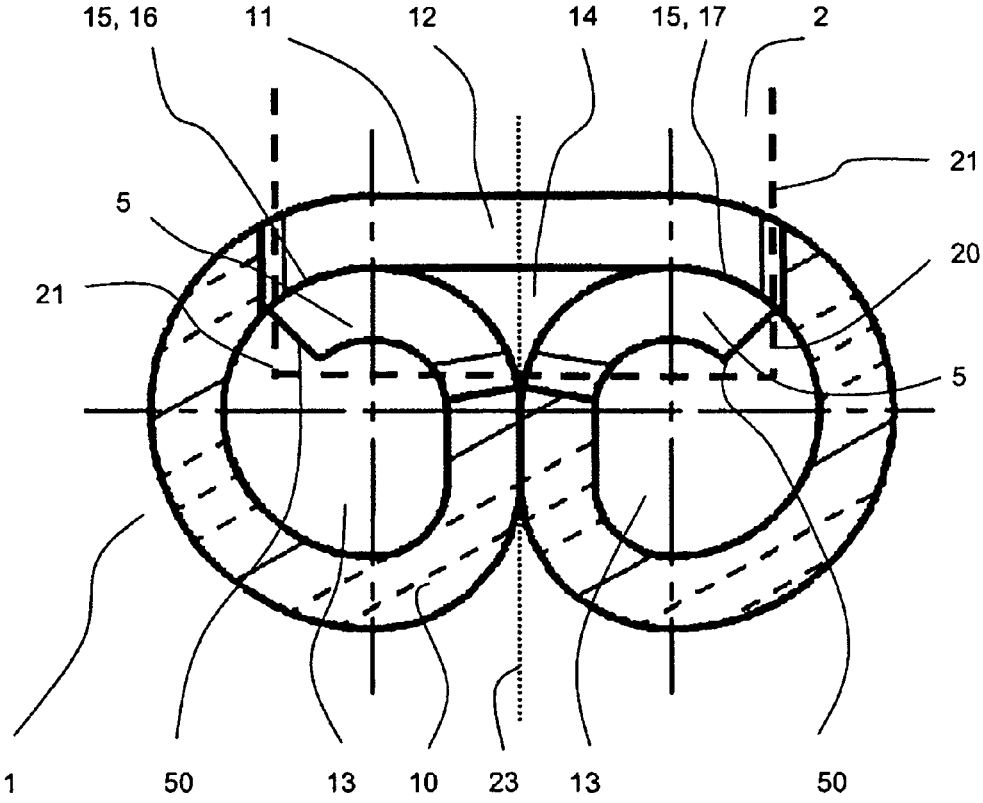
FIG. 4 shows a cross section through the collecting tube according to the invention with a heat exchanger tube.

FIG. 3 shows, on an enlarged scale in cross section, the one collecting tube 1, and how the longitudinal edge strips 5 generate the reinforcements 15 according to the invention within the approximately circular chambers 13 in the base 11 by nestling against the inner wall 10. In FIG. 4, the end 20 of a heat exchanger tube 2 is illustrated by dashed lines in addition to the cross section of the collecting tube. It can be seen from said figure how the narrow sides 21 lie in the vicinity of the longitudinal edges 50 of the metal strip, with the longitudinal edge strips 5 forming the reinforcements 15. The end of the heat exchanger tube 2 thus lies approximately at the level of the reinforcements 15 or projects into the chambers 13. The longitudinal edges 50 of the metal strip are of course a part of the two longitudinal edge strips 5 of the metal strip. The metal strip for producing the collecting tubes of a gas cooler may for example be approximately 1.5 mm thick. The reinforced surface area of the base 11 is approximately over 50% of the total surface area in this exemplary embodiment.

Figure 5:
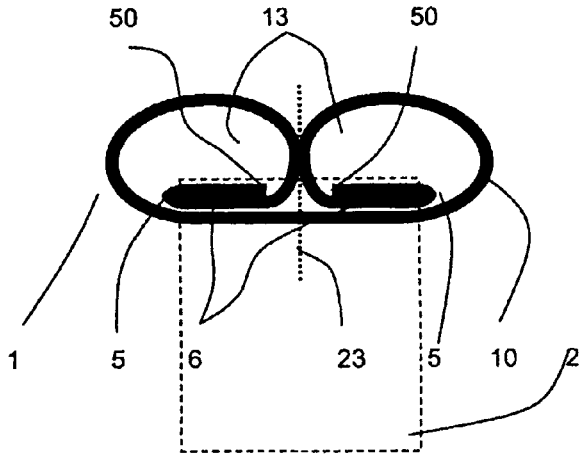
FIG. 5 shows a second exemplary embodiment of the collecting tube according to the invention.

A second exemplary embodiment of the collecting tube 1 having a wall 10 and two chambers 13 is illustrated in simplified form in FIG. 5. Here, the reinforcements 15 are formed here by an at least tripled wall thickness, with the tripled wall thickness being produced by means of folds 6. The production of the folds 6 at the longitudinal edge strips is the first deformation step of the metal strip. A fold 6 is a bend of the longitudinal edge strip 5 by approximately 180° C., see FIG. 8. Here, the longitudinal edges 50 are arranged closer, in relation to the first exemplary embodiment, to the central longitudinal axis 23 or to the boundary between the chambers 13. In the second exemplary embodiment, the reinforced surface area of the base 11 may be greater than 80% of the total surface area, as can be appreciated from FIG. 5.

Figure 6:
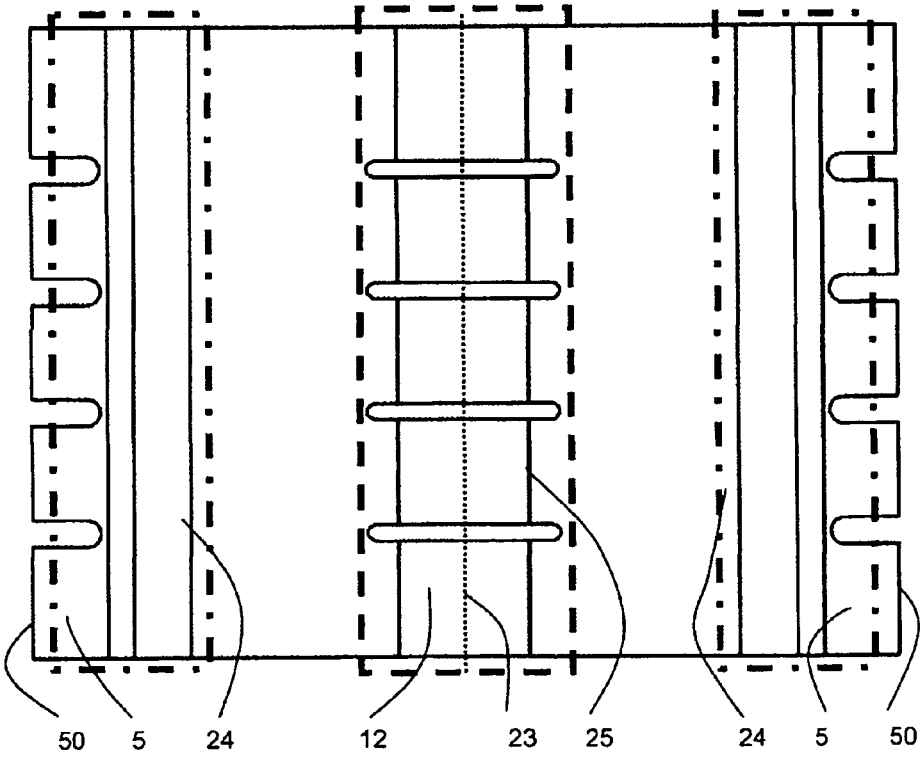
FIG. 6 shows a view of the metal strip from which the collecting tube according to the invention is produced.

The metal strip for producing the collecting tube 1 which can be seen in FIGS. 1 to 4 is illustrated in unwound form in FIG. 6, with a row of openings 12 for holding the heat exchanger tubes 2. The punched-out portions at the longitudinal edge strips 5 are arranged symmetrically with respect to the central longitudinal axis 23 of the metal strip in order to prevent distortion of the metal strip. Said punched-out portions may be formed so as to be slightly wider than the openings 12 in order to obtain a secure fit of the heat exchanger tubes 2 in the openings 12. Further punched-out portions or weakened portions are not provided on the metal strip in order to ensure the best internal pressure resistance and the best dimensional stability. The regions between the openings 12 for the heat exchanger tubes 2 are continuously intact. Dash-dotted lines show two regions 24 close to the longitudinal edges 50 on the rear side of the metal strip, in which regions 24 the surface of the metal strip is mechanically roughened in order to generate a more favorable flow of solder during the soldering process as a result of the locally improved capillary action which is thereby obtained. The quality of the soldered connections of the corresponding surfaces of the metal strip can thereby be improved with repeatable accuracy, and the reject rate is thus reduced. The roughened region 25 on the front side along the central longitudinal axis 23 of the metal strip, shown by a dashed line in the figure, fulfills the same purpose.

Figure 7:
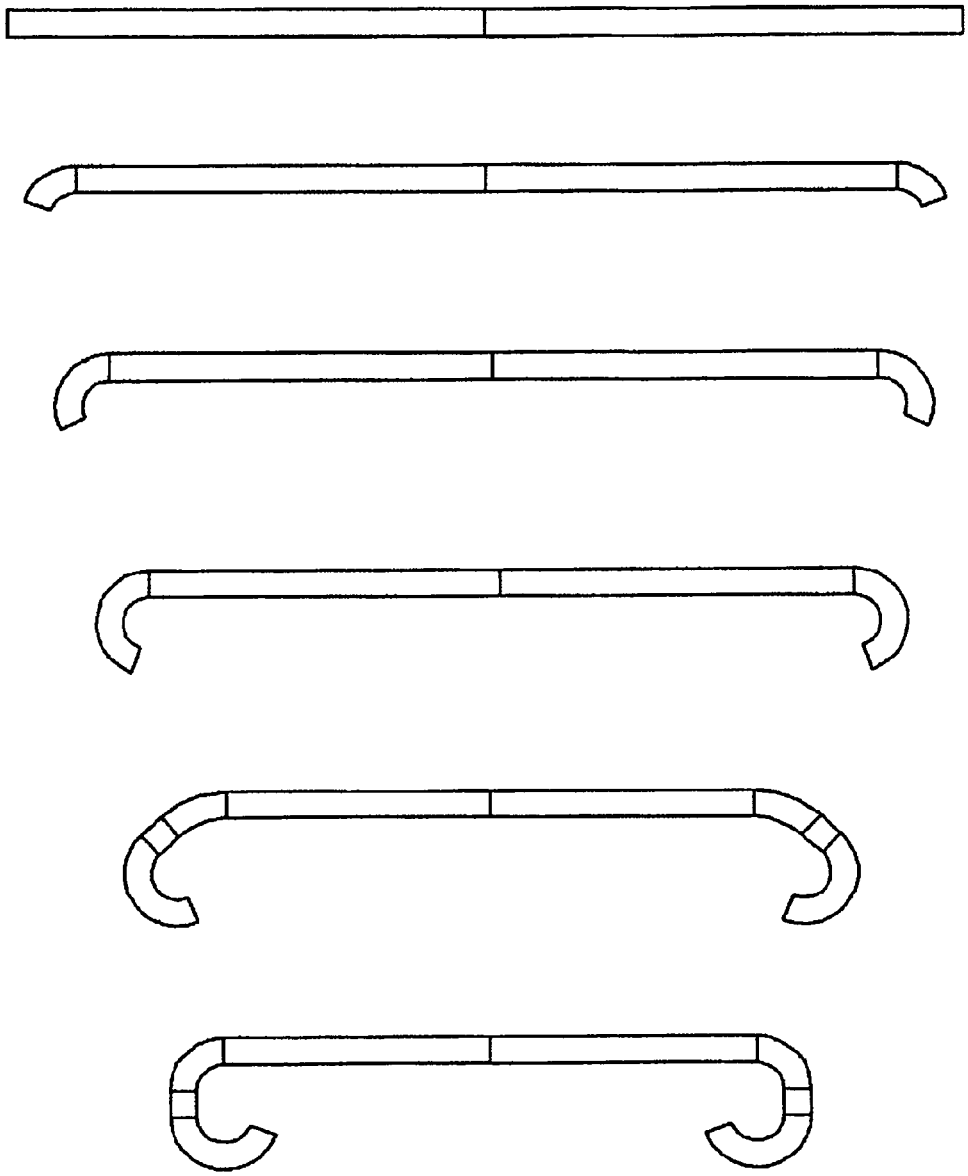
FIGS. 7 and 7A show views of the deformation sequences of the collecting tube.
Figure 7A:
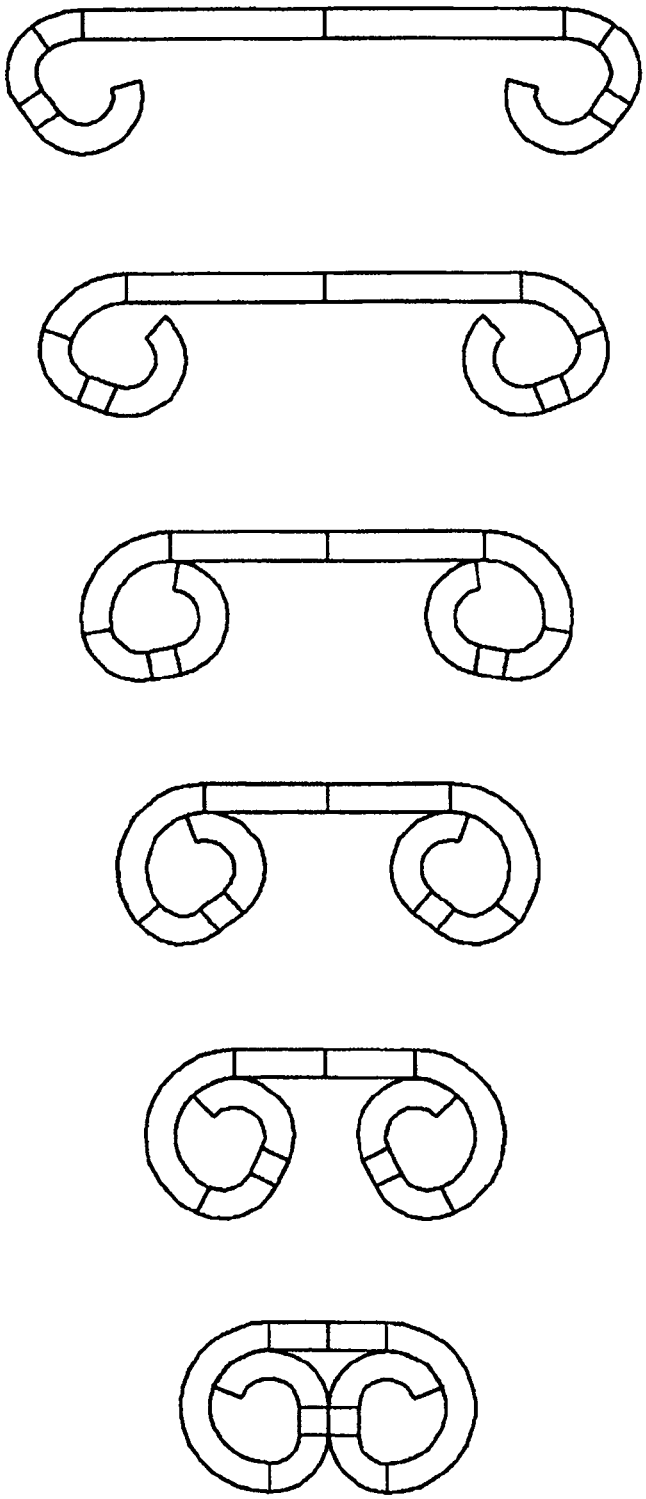

The deformation stages of the metal strip from the planar strip to the profile of the collecting tube 1 are illustrated in FIG. 7 and FIG. 7A, proceeding downward from the top of FIG. 7 and continuing in FIG. 7A from top to bottom. For the continuous deformation of the metal strip by rolling in the longitudinal edge strips 5, at least ten deformation stations with rotationally symmetrical rotating deformation tools (not shown) are used in order to keep deviations of the actual contour of the profile of the collecting tube from the intended contour as small as possible. During the rolling-in process, rolling-in rollers engage on the metal strip from above and below. In the corresponding deformation stages, the rolling-in rollers have a peripheral profile which corresponds to the illustrated shapes in the individual deformation stages. During the course of the rolling-in process, the metal strip is also held or guided in its central section by means of said rolling-in rollers until the penultimate deformation stage (FIG. 7A, $2^{nd}$ image from bottom) is reached. Accurately fitting parts can be produced with a low reject rate by means of the rolling-in process.

Figure 8:
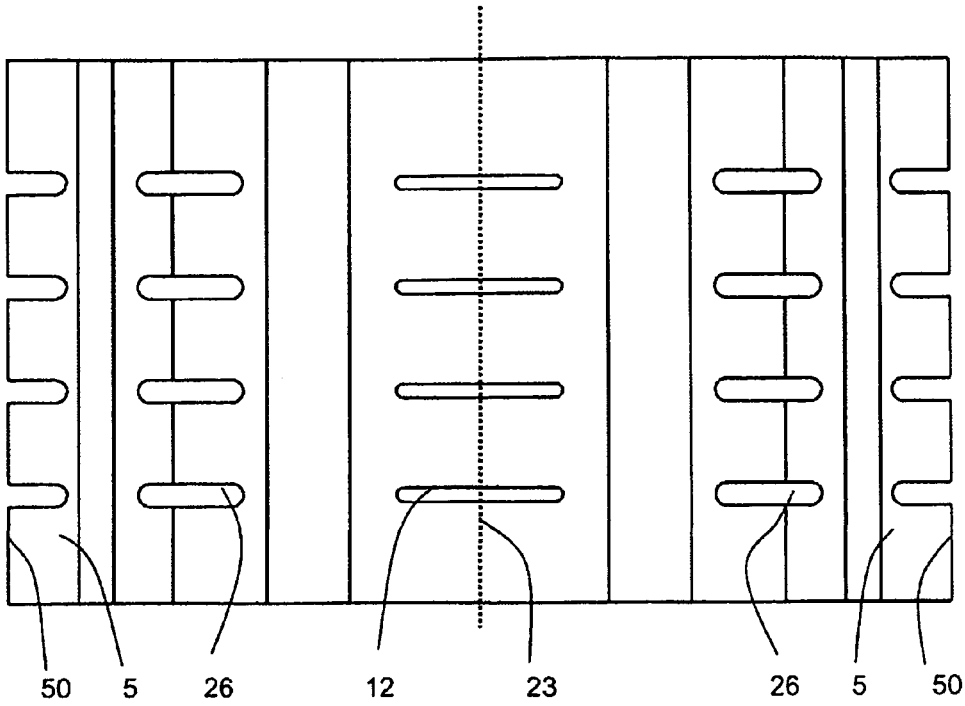
FIG. 8 shows a view of the metal strip for the second exemplary embodiment of the collecting tube.

FIG. 8 shows the view of the metal strip for a variant of the collecting tube: here, punched-out portions 26 are additionally formed in order to be able to realize the collecting tube 1 according to FIG. 5.

Figure 9:
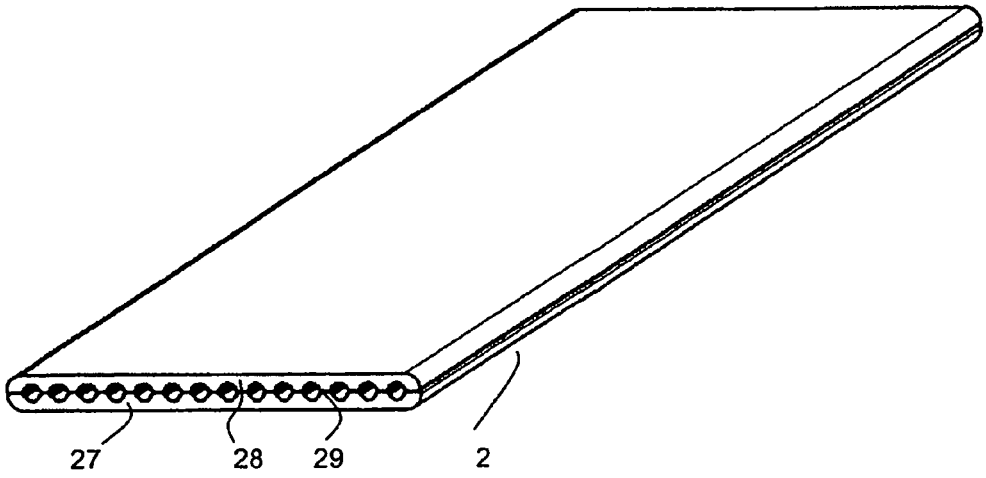
FIG. 9 shows a view of the heat exchanger tube.

A heat exchanger tube 2 which is used for the heat exchanger is illustrated in FIG. 9: the heat exchanger tube 2 is constructed from two halves 27 and 28 which may for example be produced, in a cost-effective manner with a very high degree of accuracy, as rolled aluminum profiles. The inner projections of in each case one half 27 and 28 are soldered to the associated projections 29 of the other tube half 28 in order to obtain adequate internal pressure resistance.

Various features and advantages of the invention are set forth in the following claims.

What is claimed is:

1. A heat exchanger comprising:

a collecting tube having a wall and being produced by deformation of a single metal strip, the collecting tube having a base with at least one row of openings in which heat exchanger tubes, each of which has two narrow and two wide sides, are fastened at their ends, the collecting tube having at least two chambers, which adjoin one another approximately at a central longitudinal axis of the collecting tube; and a reinforcement, which is formed by longitudinal edge strips of the metal strip, between the heat exchanger tubes, arcuate portions of the edge strips engaging correspondingly contoured interior portions of the base of the collecting tube wall, wherein the reinforcement which, is formed from the longitudinal edge strips, extends at least over ⅓ of the surface area of the base.

2. The heat exchanger according to claim 1, wherein the reinforcement is formed as a multiplied thickness of the wall.

3. The heat exchanger according to claim 2, wherein the multiple wall thickness can be produced by means of one or more fold(s) of the longitudinal edge strips of the metal strip.

4. The heat exchanger according to claim 1, wherein the longitudinal edges of the metal strip lie in a vicinity of the narrow sides of the heat exchanger tubes.

5. The heat exchanger of claim 1, wherein a narrow strip, which runs in the region of the central longitudinal axis, of the base is formed without a reinforcement.

6. The heat exchanger according to claim 1, wherein the reinforcement is formed as two parallel strips which are arranged to the left and right of the central longitudinal axis.

7. The heat exchanger according to claim 1, wherein the two longitudinal edges of the metal strip are arranged in a vicinity of the central longitudinal axis.

8. The heat exchanger according to claim 1, wherein the reinforcement is formed on an inner side of the base.

9. The heat exchanger according to claim 1, wherein the base has no further apertures and is of continuous design between the openings of the row of openings.

10. The heat exchanger according to claim 1, wherein the ends of the heat exchanger tubes lie approximately at the level of the reinforcements or extend into the adjoining chambers.

11. The heat exchanger according to claim 1, wherein the reinforced surface area of the base covers over 50% of a total surface area.

12. A collecting tube comprising:

a wall for a heat exchanger;

having at least two chambers, which adjoin one another approximately at a central longitudinal axis; and a row of openings in a base, heat exchanger tubes being securable in the openings, each of the tubes having two narrow and two wide sides;

wherein the collecting tube is produced by deformation of a single metal strip and has a reinforcement, which is formed by the longitudinal edge strips of the metal strip of the base, the longitudinal edge strips including arcuate portions nested in concave interior portions of the base of the heat exchanger wall;

wherein the reinforcement extends at least over ⅓ of a surface area of the base.

13. The collecting tube according to claim 12, wherein in the overlapping regions of the metal strip along the central longitudinal axis and on the base, the corresponding surfaces of the metal strip have a suitable greater surface roughness in relation to the non-overlapping regions of the metal strip.

14. A method for producing a collecting tube, the method comprising the acts of:

providing a single metal strip which has two longitudinal edge strips;

forming openings in the metal strip and cutouts which come to rest in a base of the collecting tube; and shaping the metal strip such that two chambers which adjoin one another approximately at a central longitudinal axis of the collecting tube are formed;

rolling the two longitudinal edge strips inwardly such that arcuate portions of the rolled edge strips bear against an arcuately shaped portion of an inner side of the base to reinforce at least ⅓ of the surface area of the base.

15. The method according to claim 14, wherein the longitudinal edge strips are folded before being rolled.

16. The method according to claim 14, wherein chambers with an approximately round to oval cross section are generated by the rolling process.

* * * * *